US011773547B2

(12) United States Patent
Neusch

(10) Patent No.: US 11,773,547 B2
(45) **Date of Patent: *Oct. 3, 2023**

(54) SHALLOW MOUNT BOLLARD

(71) Applicant: NEUSCH INNOVATIONS, LP, Marble Falls, TX (US)

(72) Inventor: William H. Neusch, Marble Falls, TX (US)

( * ) Notice: Subject to any disclaimer, the term of this patent is extended or adjusted under 35 U.S.C. 154(b) by 117 days.

This patent is subject to a terminal disclaimer.

(21) Appl. No.: 17/222,277

(22) Filed: Apr. 5, 2021

(65) Prior Publication Data

US 2021/0222382 A1 Jul. 22, 2021

Related U.S. Application Data

(63) Continuation of application No. 17/124,410, filed on Dec. 16, 2020, now Pat. No. 10,988,903.

(60) Provisional application No. 62/949,330, filed on Dec. 17, 2019.

(51) Int. Cl.
*E01F 15/00* (2006.01)

(52) U.S. Cl.
CPC ..... *E01F 15/003* (2013.01)

(58) Field of Classification Search
CPC ..... E01F 15/00; E01F 15/003
See application file for complete search history.

(56) References Cited

U.S. PATENT DOCUMENTS

| | | | |
|---|---|---|---|
| 1,449,518 | A | 3/1923 | Lawson |
| 1,969,845 | A | 8/1934 | Hick |
| 5,228,237 | A | 7/1993 | Nasatka |
| 5,406,663 | A | 4/1995 | Chen |
| 6,422,783 | B1 | 7/2002 | Jordan |
| 6,702,512 | B1 | 3/2004 | Reale |
| 6,805,515 | B2 | 10/2004 | Reale |
| 7,040,836 | B2 | 5/2006 | Rogers et al. |
| 7,118,304 | B2 | 10/2006 | Turpin et al. |
| 7,607,856 | B2 | 10/2009 | Patel |

(Continued)

FOREIGN PATENT DOCUMENTS

| | | | |
|---|---|---|---|
| AU | 7144900 | A | 5/2001 |
| CA | 2142383 | A1 | 8/1996 |

(Continued)

OTHER PUBLICATIONS

DOS SD-STD-02.01, Revision A Draft, Test Method for Vehicle Crash Testing of Perimeter Barriers and Gates, Jan. 2003.

(Continued)

*Primary Examiner* — Thomas B Will
*Assistant Examiner* — Katherine J Chu
(74) *Attorney, Agent, or Firm* — Bradley Arant Boult Cummings LLP; Henry L. Ehrlich

(57) ABSTRACT

A bollard assembly includes a bottom plate with a forward edge and an aft edge, an elongated member mounted on the bottom plate and extending from a forward end to an aft end in a direction from the forward edge toward the aft edge, a bollard secured to the bottom plate with a bollard section of the elongated member disposed inside of the bollard, bars mounted on the bottom plate on opposite sides of the elongated member, and a top plate having a smaller perimeter than the bottom plate mounted on the elongated member and the bars with the bollard extending above the top plate.

20 Claims, 14 Drawing Sheets

(56) References Cited

U.S. PATENT DOCUMENTS

| | | | | |
|---|---|---|---|---|
| 7,699,558 | B2 | 4/2010 | Adler et al. | |
| 7,775,738 | B2 | 8/2010 | Darcy | |
| 7,850,391 | B2 | 12/2010 | Omar | |
| 8,197,156 | B2 | 6/2012 | Morgan et al. | |
| 8,215,865 | B2 | 7/2012 | Adler et al. | |
| 8,277,143 | B2 | 10/2012 | Adler et al. | |
| 9,127,422 | B2 | 9/2015 | Ball | |
| 9,133,590 | B2 | 9/2015 | Ball | |
| 10,501,957 | B1 * | 12/2019 | Borowiak | E01F 9/685 |
| 10,753,055 | B2 | 8/2020 | Tosolini et al. | |
| 10,875,368 | B1 | 12/2020 | Angel et al. | |
| 11,174,606 | B1 | 11/2021 | Lamore | |
| 2004/0033106 | A1 | 2/2004 | Turpin et al. | |
| 2006/0090408 | A1 | 5/2006 | Darcy | |
| 2007/0007500 | A1 | 1/2007 | Neusch | |
| 2007/0086858 | A1 | 4/2007 | Morgan et al. | |
| 2008/0181721 | A1 | 7/2008 | Neusch | |
| 2009/0003032 | A1 | 1/2009 | Philipp et al. | |
| 2009/0028638 | A1 | 1/2009 | Crawford et al. | |
| 2009/0250674 | A1 | 10/2009 | Darcy | |
| 2011/0033232 | A1 | 2/2011 | Adler et al. | |
| 2011/0062403 | A1 | 3/2011 | Neusch | |
| 2012/0308302 | A1 | 12/2012 | Adler et al. | |
| 2014/0003867 | A1 | 1/2014 | Ball | |
| 2016/0115662 | A1 | 4/2016 | Neusch | |
| 2016/0356006 | A1 | 12/2016 | Neusch | |
| 2018/0016760 | A1 | 1/2018 | Neusch | |
| 2018/0119373 | A1 | 5/2018 | Neusch | |
| 2019/0063020 | A1 | 2/2019 | Neusch | |
| 2019/0154407 | A1 | 5/2019 | Neusch | |
| 2019/0186092 | A1 | 6/2019 | Neusch | |
| 2020/0056339 | A1 | 2/2020 | Ball | |

FOREIGN PATENT DOCUMENTS

| | | | | | |
|---|---|---|---|---|---|
| DE | 4004851 | A1 | | 8/1991 | |
| DE | 29717516 | U1 | | 1/1998 | |
| EP | 3441527 | B1 | * | 9/2020 | E01F 13/00 |
| GB | 2487582 | A | | 8/2012 | |
| GB | 2490118 | A | | 10/2012 | |
| GB | 2498161 | B | | 5/2017 | |
| GB | 2591428 | A | * | 8/2021 | E01F 13/00 |
| JP | 10176314 | A | | 6/1998 | |
| JP | 11061746 | A | | 5/1999 | |
| JP | 2001295298 | A | | 10/2001 | |
| JP | 2002115324 | A | | 4/2002 | |

OTHER PUBLICATIONS

ASTM F2656-07 Standard Test Method for Vehicle Crash Testing of Perimeter Barriers, Aug. 2007.

ASTM F3016/F3016M-19 Standard Test Method for Surrogate Testing of Vehicle Impact Protective Devices at Low Speeds, Sep. 2019.

Ameristar/ATG Access Shallow Mount Defender Anti-Ram Bollards Brochure, May 2014.

Ameristar/ATG Access Shallow Mount SP 1000 Defender Anti-Ram Bollards Brochure, May 2014.

ATG Access Westminster Bridge Protection Bollard Brochure.

Ameristar Shallow Mount Bollard Installation Document.

Ameristar K4 Shallow Mount Bollard Drawing, Mar. 29, 2013.

Elkosta Perimeter Protection M50 Fixed Shallow Mounted Bollard, Technical Data Sheet, Mar. 3, 2013.

* cited by examiner

SHALLOW MOUNT BOLLARD

BACKGROUND

This section provides background information to facilitate a better understanding of the various aspects of the disclosure. It should be understood that the statements in this section of this document are to be read in this light, and not as admissions of prior art.

Vehicle barrier systems are used to protect premises and people from the unauthorized entry of vehicles. Anti-ram vehicle barriers (AVB) systems or vehicle security barriers (VSB) are configured to stop motor vehicles, such as trucks, that crash into the barrier. Some AVBs are designed to stop vehicles that are intentionally crashed into the barrier in an attempt to enter the protected area for nefarious purposes.

Some anti-ram vehicle barriers are crash tested to ensure compliance with and obtain certification from a recognized standard. For example, the American Standard Test Method (ASTM F2656 and F3016), British Standard Institute (PAS 68) and the International Organization for Standardization (ISO) and International Works Agreement (IWA 14-1).

The U.S. State Department (DOS) published the certification standard SD-STD-02.01 (Test Method for Vehicle Crash Testing of Perimeter Barriers and Gates) in 1985. The test vehicle was specified as a medium-duty truck weighing 15,000 lb. (6800 kg) and the nominal velocities were 30 mph (50 km/h), 40 mph (65 km/h) and 50 mph (80 km/h). Penetration was measured from the pre-impact attack (front) side of the vehicle security barrier (VSB) and classified into three categories of penetration rating. In 2003, the standard was revised with measuring the penetration from the asset or protected (rear) side of the barrier and the limitation of permissible vehicle penetration to one meter (the highest level of penetration rating).

In 2007, the SD-STD-02.01 was replaced with ASTM F2656-07. This new standard included the medium-duty truck and added three new test vehicle types, a small passenger car, pickup truck, and a heavy goods truck. ASTM F2656-07 maintained three predetermined impact velocities for each vehicle category and penetration is measured from the rear face of the barrier and classified into four categories of penetration rating. The penetration ratings include P1 for less than or equal to 1 m (3.3 ft); P2 for 1.10 to 7 m (3.31 to 23.0 ft); P3 for 7.01 to 30 m (23.1 to 98.4 ft); and P4 for 30 m (98 ft) or greater. ASTM F2656 was revised in 2015 (ASTM F2656-15) to include two additional vehicle types, a full-sized sedan and a cab over/cab forward class 7 truck and it excluded the lowest penetration rating (P4). Vehicle categories include M-ratings: medium duty truck (15,000 lb.); C-rating: small passenger car (2,430 lb.); PU-rating: pickup truck (5,070 lb.); and H-ratings: heavy goods vehicle (65,000 lb.). As an example, an M-rating is an equivalent vehicle as a K-rating. An M50-P1 certified barrier has been tested by impacting a 15,000-lb. vehicle travelling perpendicular to the barrier at 50 mph and stopping the vehicle within 1 meter of the barrier.

ASTM F3016 establishes standards for anti-ram at low speeds. Whereas ASTM F2656 addresses greater speeds and different weight vehicles such as may be used in an intentional act, such as a terrorist attack, ASTM F3016 addresses standards for vehicle safety barriers to protect pedestrians and storefront property. Storefronts, bus stops, restaurant patios, sidewalks, propane tanks, and gasoline pumps are examples of protected areas particularly suited for F3016 type vehicle safety barriers. ASTM F3016 provides for a range of low impact speeds, 20 to 60 km/h (10 to 30 mph), with a 22,250 N (5,000 lb) test vehicle. Penetration ratings are based on displacement of the barrier into the protected area or maximum intrusion of the vehicle impactor nose into the protected area. The speed ratings are S10 (20 km/h; 10 mph); S20 (35 km/h; 20 mph); and S30 (50 km/h; 30 mph) and penetration ratings are P1 (less than or equal to 0.30 m; 1 ft) and P2 (0.31-1.22 m; 1 ft). Penetration of greater than P2 is a failure.

In 2005, the British Standard Institute (BSI) published PAS 68:2005 Specification for Vehicle Barriers: Fixed Bollards. The standard was expanded within two years to include other types of barriers, such as gates and road blockers. The 2013 version, "Impact Test Specifications for Vehicle Security Barrier Systems," rates vehicle barrier systems based on six types of test vehicles, including seven test speeds, and penetration is measured from the rear (protected side) face of the barrier. PAS 68 defines the vehicle type, penetration, dispersion of debris and records the angle of the vehicle's approach. The PAS 68 rating includes a five-to-seven-part classification code, the includes: Classification of Test/Gross Weight of Vehicle (kg) (Vehicle Class)/Impact Speed/Angle of Impact: Distance Leading Edge of Load Bay travels beyond the Original Position of Rear Face/Dispersion Distance of major debris weighing 25 kg or more from the barrier to establish stand-off distance. For example, a barrier (bollard) tested by impact by a 7500 kg day cab ("V") at a ninety-degree angle traveling 80 km/h and resulting in penetration of 7.5 m with significant debris scattered up to 20.0 m away would be designated as V/7500(N3)/80/90:7.5/20.0. The dispersion distance may be used to determine a stand-off distance for example to mitigate damage from a vehicle born improvised explosive device (VBIED).

The European Committee for Standardization (CEN) recognized across 34 European countries has produced a standard CWA 16221 that combines details of PAS 68 and PAS 69. PAS 69 provides guidance on the barrier's use and installation.

In 2013, the International Works Agreement (IWA) 14-1: 2013 was published to provide an international specification for crash-testing. The system was developed by government agencies, military bodies and providing companies from the USA, UK, Germany, Norway, Oman, Singapore, and Syria. This standard includes a merging of vehicle impact test specifications of the British PAS 68 and the American ASTM F2656. This international standard assesses vehicle barrier performance based on nine types of test vehicles with up to seven test speeds. Penetration is measured from the front (attack side) face of the AVB. The IWA 14 classification code represents Vehicle Impact Test/Gross Weight of Vehicle (Vehicle Class)/Impact Speed/Angle of Impact/Penetration beyond the original position of the Front/Impact face.

Vehicle safety barriers may be designated or marketed as crash-rated, certified, or engineer-rated. Certified or crash-rated systems have been crash-tested and certified by an independent testing facility pursuant to a referenced testing standard, e.g., ASTM, PAS, IWA. Engineered or engineer-rated systems have been designed and computer-analyzed to meet a designation within a referenced standard but not crashed tested or certified.

SUMMARY

An exemplary bollard assembly includes a bottom plate having a bottom plate perimeter with a forward edge and an aft edge, an elongated member mounted on the bottom plate and extending from a forward end to an aft end in a direction from the forward edge toward the aft edge, the elongated member including a bollard section with a vertical height, a forward section from the bollard section to the forward end, an aft section from the bollard section to the aft end, and the forward section and the aft section having a nominal height that is less than the vertical height, a bollard attached to the bottom plate with the bollard section disposed inside of the bollard, bars mounted on the bottom plate on opposite sides of the elongated member and extending in a direction from the forward end toward the aft end, and a top plate, having a front end, a rear end, and a top plate perimeter that is smaller than the bottom plate perimeter, mounted on the elongated member and the bars with the bollard extending above the top plate.

Another exemplary bollard assembly include a bottom plate having a bottom plate perimeter with a forward edge and an aft edge, an elongated member mounted on the bottom plate and extending from a forward end to an aft end in a direction from the forward edge toward the aft edge, the elongated member including a bollard section with a vertical height, a forward section from the bollard section to the forward end, an aft section from the bollard section to the aft end, and the forward section and the aft section having a nominal height that is less than the vertical height, a bollard attached to the bottom plate with the bollard section disposed inside of the bollard, a rail having the nominal height mounted on the bottom plate proximate the forward end and extending substantially normal to the elongated member, bars, mounted on the bottom plate on opposite sides of the elongated member, extending in a direction from the forward end toward the aft end, and a top plate, having a front end, a rear end, and a top plate perimeter that is smaller than the bottom plate perimeter, mounted on the elongated member and the bars with the bollard extending above the top plate.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
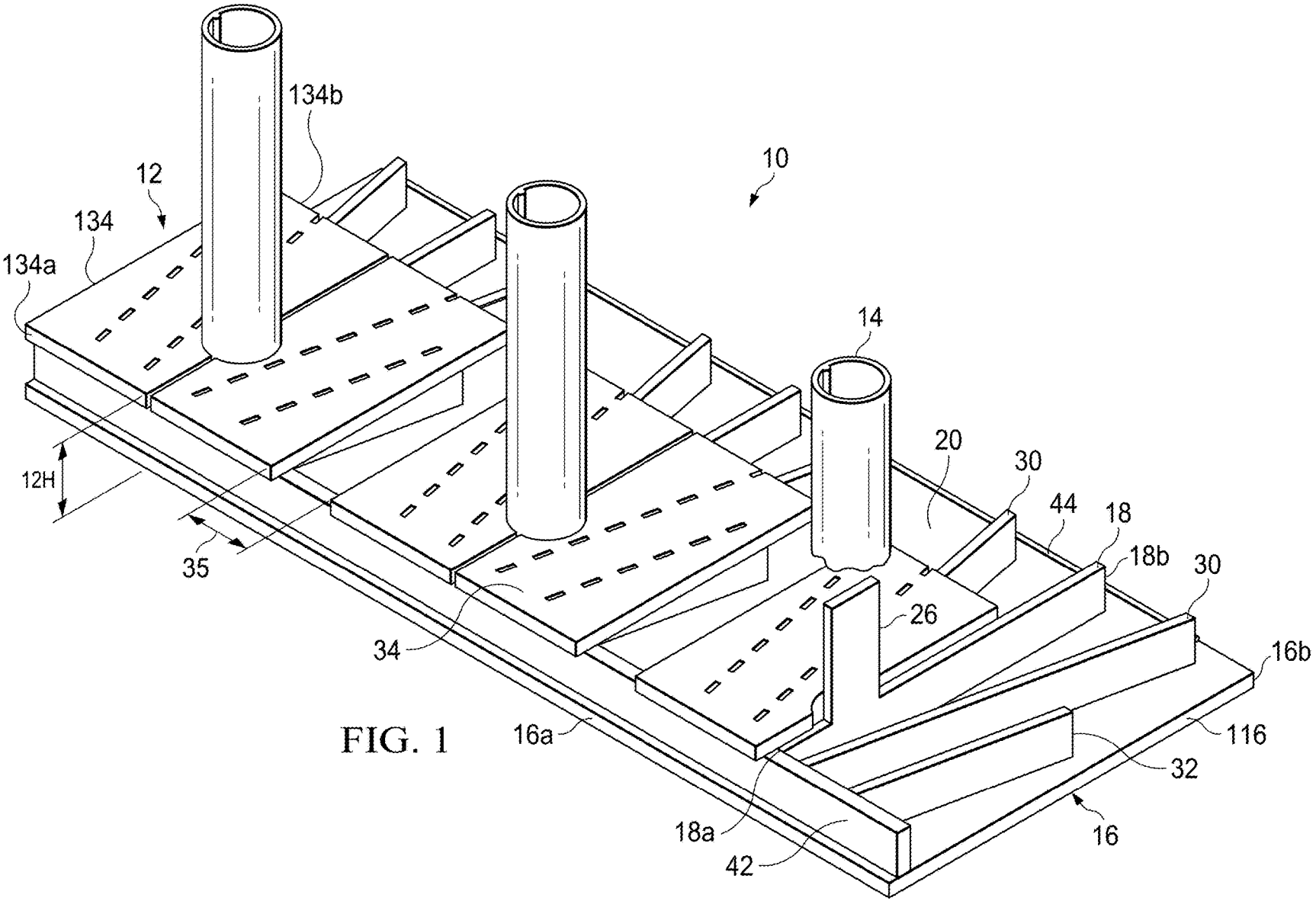
FIG. 1 is a perspective view of an exemplary bollard assembly in a linear configuration.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

With reference to FIGS. 1-19, exemplary embodiments of a shallow mount bollard assembly 10 configured to be crash-rated by certifying agencies such as DOD, DOS, American Standard Test Method (ASTM), British Standards Institution (BSI) and International Standardization Institution (ISO). Some embodiments of the disclosed shallow mount bollard assembly 10 may be engineered crash-rated but not crash tested. Some embodiments of the disclosed shallow mount bollard assembly 10 may not be engineered crash-rated or crash tested.

Bollard assembly 10 may be constructed offsite and transported to a site for installation. As is known in the art, protective barriers are erected to separate a protected area on one side of the barrier from vehicles approaching from the opposite side of the barrier, which is often referred to as the attack side. Although a vehicle barrier may be bi-directional and thus capable of stopping or impeding a vehicle approaching from either direction, anti-ram barriers are commonly configured to have a higher resistance to vehicle penetration from the attack side toward the protected side. The exemplary bollard assemblies illustrated and described are suited to be utilized as an anti-ram vehicle barrier to stop vehicles that are intentionally trying to penetrate into an area protected by the bollards. An exemplary embodiment is crash-tested and certified to an ASTM F2565-15 M40-P1 test specification as a single bollard. Bollard assembly 10 may also be configured as a safety barrier at locations that are not subject to "terrorist" attacks, but subject to accidental vehicle penetrations such as at storefronts.

Bollard assembly 10 includes a base assembly 12 and one or more vertical bollards 14. The bollard assemblies illustrated in this disclosure include two or more vertical bollards, however, bollard assembly 10 is not limited to the number of bollards shown in the illustrated exemplary embodiments. Bollard assemblies 10 may include one or more bollards 14. As will be understood by those skilled in the art with benefit of this disclosure, bollard assemblies are described herein with exemplary dimensions and materials of construction.

With reference in particular to FIG. 1, base assembly 12 includes a bottom plate 16 extending the length of the bollard assembly, at least one bollard stiffener 18, and a top plate 34 separated from the bottom plate 16 by bollard stiffener 18. Base assembly 12 is configured to be placed in an excavation and set-in concrete, see for example FIGS. 2, 2A, and 3. The concrete foundation does not require rebar. Base assembly 12 provides a shallow mount, for example, base assembly may have a base height 12H of 12 inches or less. In an exemplary embodiment illustrated herein, base assembly has a base height of about 5 inches. In some configurations, base assembly may have a height less than 5 inches. Bollard 14 is mounted each bollard stiffener 18, see for example FIGS. 4-9.

Bollard 14 is constructed of metal pipe supported by an elongated bollard stiffener member 18 that is mounted on a top surface 20 of bottom plate 16. Bollard stiffener 18 reinforces the connection of bollard 14 to plate 16 and strengthens plate 16 to resist bending of plate 16 and bending, e.g., rotation or tipping, of bollard 14 when bollard 14 is impacted by a vehicle. Bollard assembly 10 is configured to resist bending or tipping of bollard sufficient to stop an impacting motor vehicle within a determined distance with regard to crash-certified or engineered-rated bollard assembly.

Figure 6:
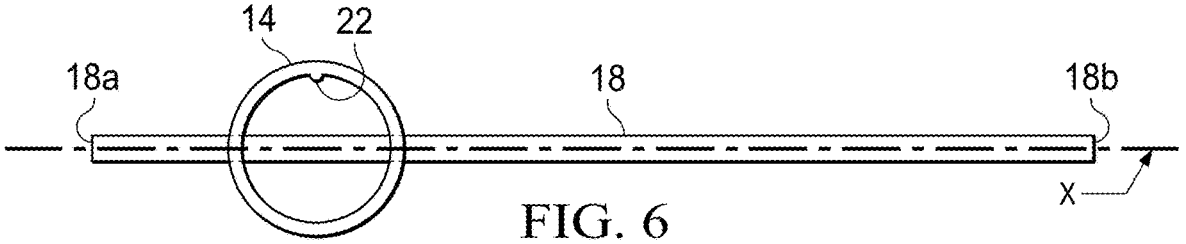
FIG. 6 is a top view illustrating an example of a bollard arranged with a bollard stiffener.
Figure 7:
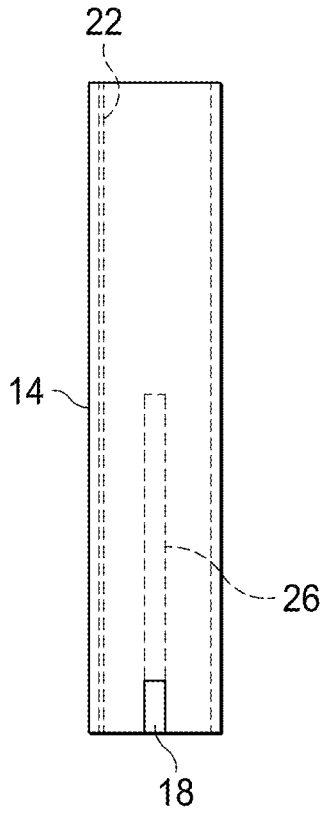
FIG. 7 is a front elevation view of an example of a bollard arranged with a bollard stiffener.
Figure 9:
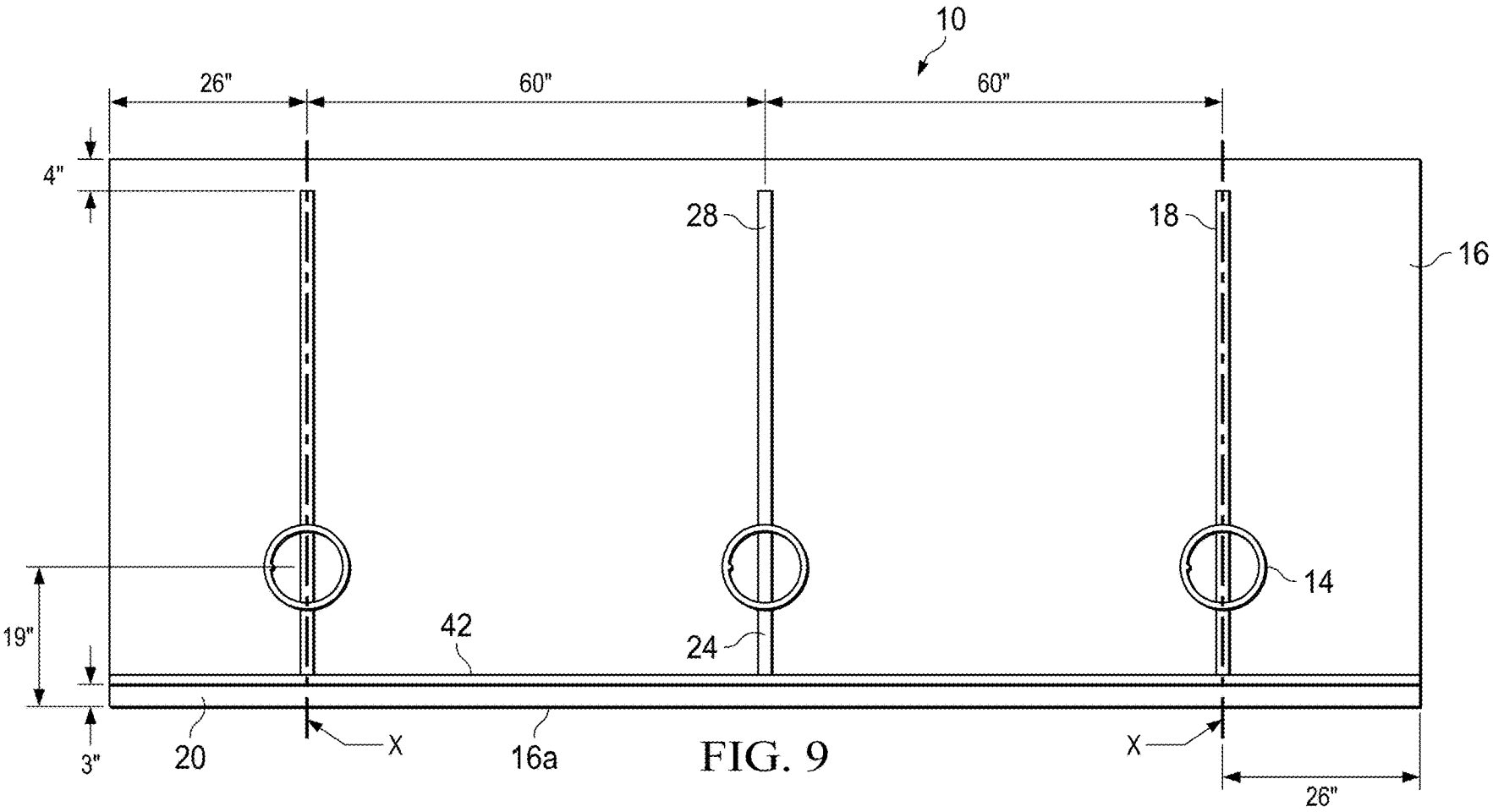
FIG. 9 is a plan view of an exemplary three bollard configuration illustrating each of the bollards mounted on a respective bollard stiffener and a bottom plate.
Figure 10:
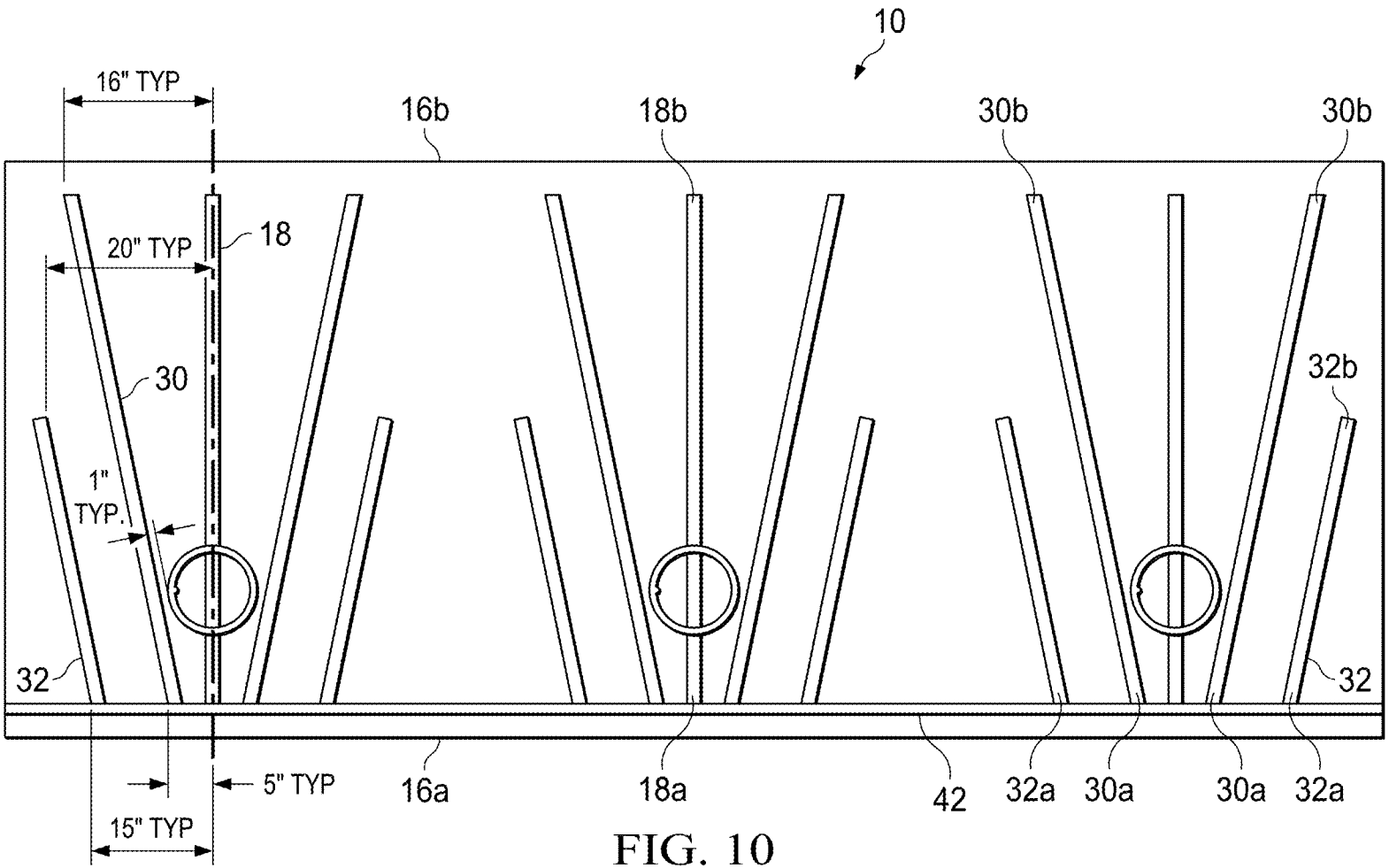
FIG. 10 is a plan view illustrating additional stiffeners positioned on the opposite sides of the bollard stiffeners.

Each bollard 14 is mounted with a respective bollard stiffener 18, accordingly a base in a single bollard configuration will have a single bollard stiffener 18, a two-bollard configuration will have two bollard stiffeners 18, etc. Bollard stiffener 18 is co-axial with a fore to aft axis "X" (FIGS. 6, 9). Axis X is defined relative to each bollard, thus a bollard assembly having two or more bollards may have two or more axes X that may not be parallel to one another in a non-linear barrier. For example, bollard stiffeners 18 in a linear bollard assembly, such as illustrated in FIGS. 1, 2, and 9-11, are parallel to one another. In non-linear bollard assemblies, such as illustrated in FIGS. 14-17, bollard stiffeners 18 are not parallel to one-another. As will be understood by those skilled in the art with benefit of this disclosure, each bollard stiffener 18 extends along an axis that may be oriented with the expected path of travel of an impacting vehicle.

Exemplary bollards 14 are illustrated as 10-inch, schedule 60 pipe. The diameter and characteristics of bollard 14 may be selected for the intended use, for example bollard 14 may have a diameter smaller or larger than 10 inches. Bollard 14 may be constructed of pipe having a seam 22. Seam 22 is offset from axial alignment with bollard stiffener 18. Seam 22 is positioned generally normal to bollard stiffener 18 and axis X. Bollard 14 includes a slot 14*a* extending upward from the bollard bottom end 14*b* to dispose bollard stiffener 18 so that bottom end 14*b* is in direct contact with top surface 20 of bottom plate 16. Slot 90 is located 90 degrees from seam 22.

Bollard stiffener 18 is an elongated member extending from a forward end 18*a* to an aft end 18*b*. Bollard stiffener 18 has a forward section 24, a bollard or vertical section 26, and an aft section 28. Bollard section 26 is disposed inside of bollard 14 and strengthens the connection of bollard 14 to plate 16 and resists tipping of the bollard when impacted by a vehicle and to transmit impact forces to plate 16. Bollard stiffener 18 has a nominal height 18H and a different bollard section height 26H positioned inside of bollard 14.

Figure 5:
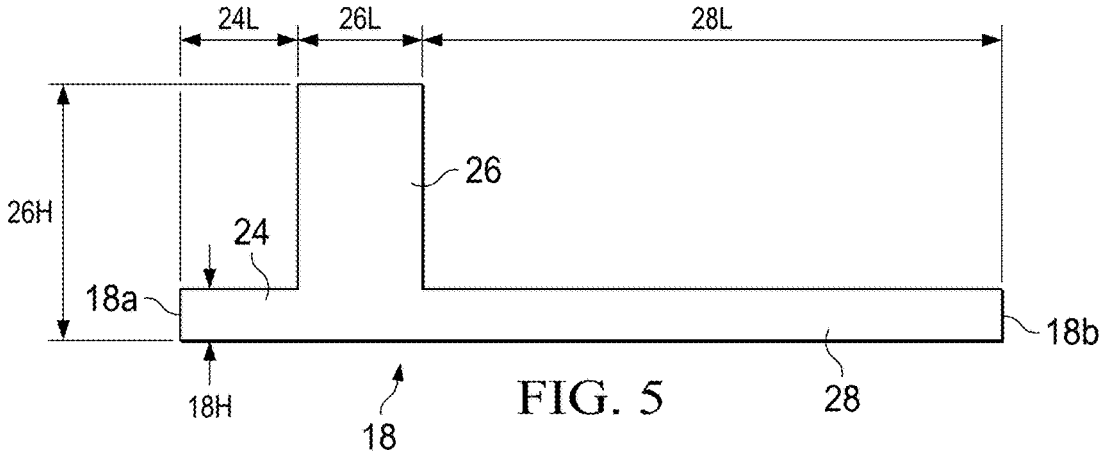
FIG. 5 illustrates an exemplary bollard stiffener in isolation.
Figure 8:
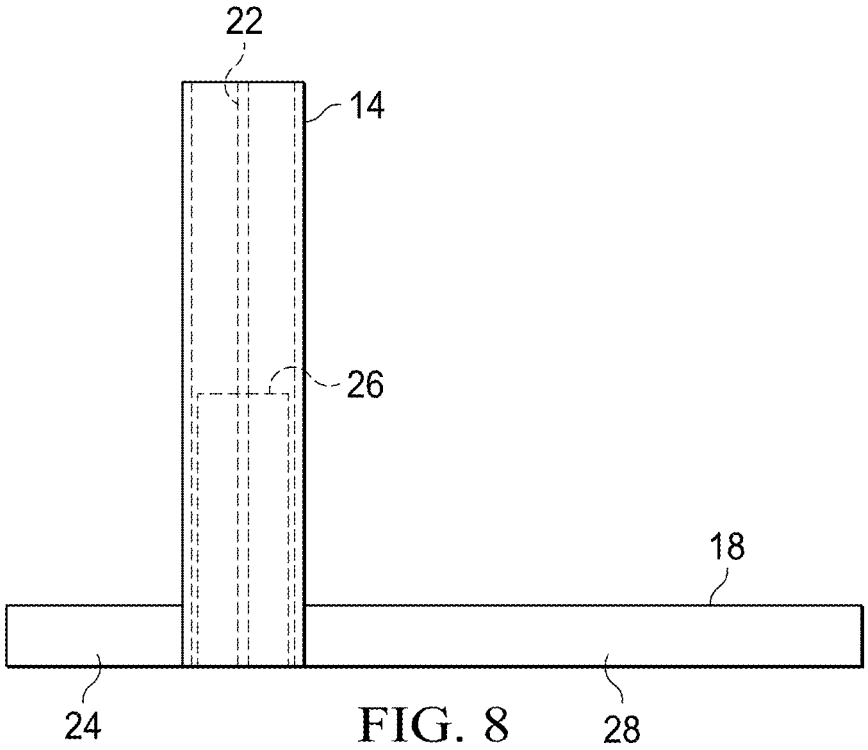
FIG. 8 is a side elevation view of an example of a bollard arranged with a bollard stiffener.

In this exemplary embodiment, bollard stiffener 18 is constructed of 1.5-inch-thick steel plate (flat bar), e.g., ASTM A572 GR50. The thickness is less than the vertical height and less than the length. With reference to FIGS. 5, 6, and 8, forward section 24 extends forward of bollard section 26 a distance 24L to forward end 18*a* and aft section 28 extends aft of bollard section 26 to aft end 18*b*. In this exemplary embodiment, bollard stiffener 18 has a nominal height 18H of about 4 inches along forward and aft sections 24, 28 and a bollard section height 26H of about 20 inches. Forward length 24L is less than aft length 28L. For example, in an embodiment with a base width 16W of about 72 inches, forward length 24L is about 9 inches, bollard section length 26L fits the inside diameter of bollard 14 and extends about 9.5 inches for a 10-inch bollard, and aft length 28L is about 44 inches for a total length of about 62 inches. Bollard 14 is not limited to a 10-inch diameter tubular. In the illustrated embodiments, bollard stiffener 18 does not extend to the forward and aft edges 16*a*, 16*b* of bottom plate 16.

Bollard assembly 10 may include one or more elongated stiffener members located on opposite sides of each bollard stiffener 18. For example, with reference in particular to FIGS. 2, 10, and 11 an exemplary embodiment includes a first stiffener 30 and a second stiffener 32 located on each side of bollard stiffener 18. In some embodiments, only one stiffener may be positioned on opposite sides of each bollard stiffener 18. For example, bollard assembly 10 may not include stiffeners 32. Stiffeners 30 and 32 may be constructed of a similar material as bollard stiffener 18 and have an equivalent nominal height. For example, in an exemplary embodiment, stiffeners 30, 32 are steel flat bars, e.g., 1.5 inches thick, with the same nominal height as bollard stiffener 18.

First stiffeners 30 are mounted on bottom plate 16 on each side of each bollard stiffener 18. Stiffeners 30 have a forward or attack end 30*a* and an aft end 30*b*. Forward ends 30*a* (terminal ends) are aligned even with forward end 18*a* of bollard stiffener 18 and aft ends 30*b* are aligned with aft end 18*b*. Stiffeners 30 are angled outward and away from bollard stiffener 18 in the direction from the attack end 30*a* to the aft end 30*b*. In an example, stiffeners 30 extend at an angle of about 12 degrees relative to bollard stiffener 18. Stiffeners 30 have a nominal height equal to the nominal height of bollard stiffeners 18. In some embodiments, second stiffeners 32 are positioned outside of first stiffeners 30 relative to bollard stiffener 18. The forward or attack ends 32*a* of stiffeners 32 are aligned even with the attack ends of stiffeners 18, 30. Stiffeners 30, 32 may be parallel to one another. Stiffeners 30 and 32 provide strength to plate 16 against bending when bollard 14 is impacted by a vehicle.

Figure 2:
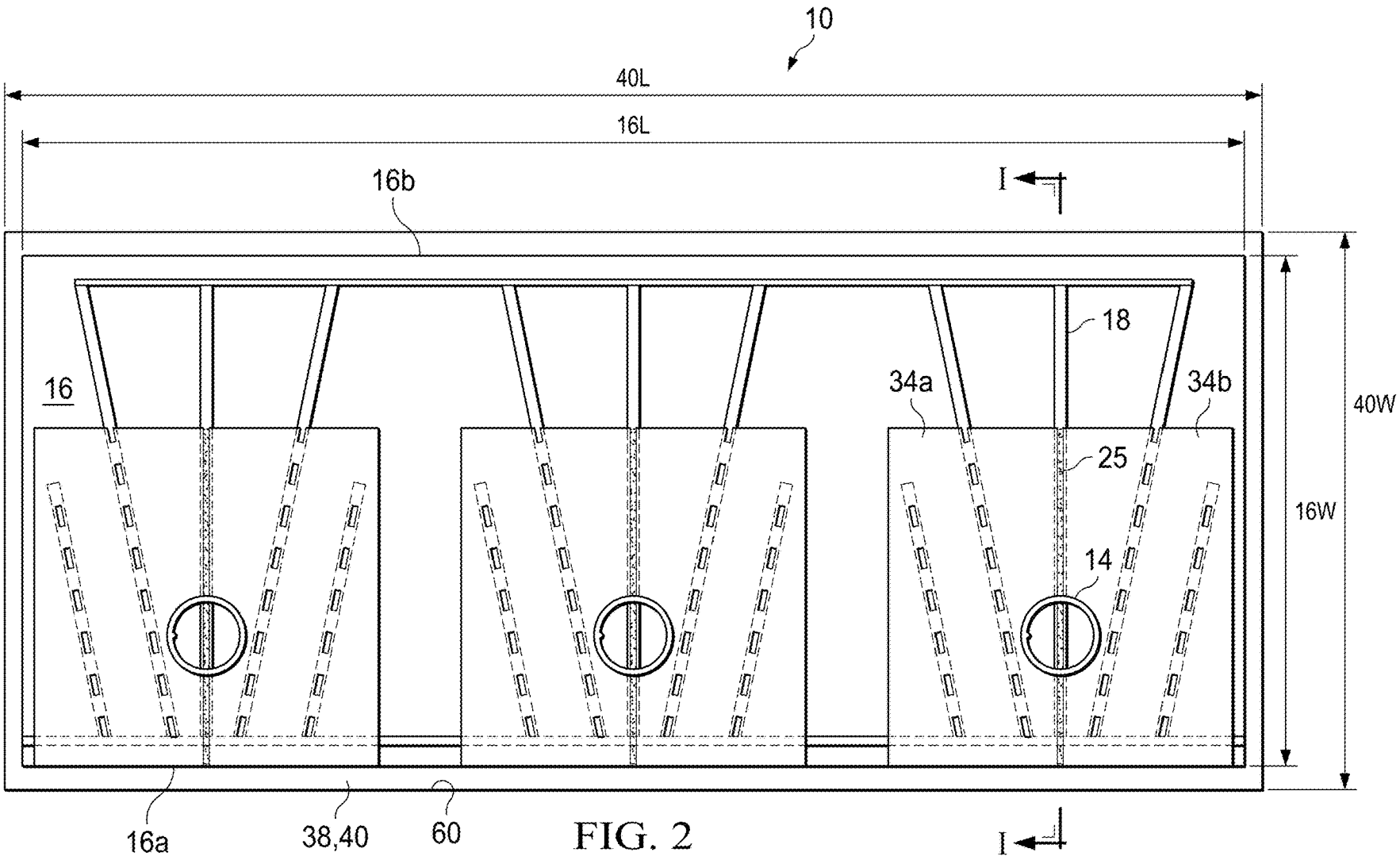
FIG. 2 is a plan view of an exemplary bollard assembly in a linear configuration.
Figure 2A:
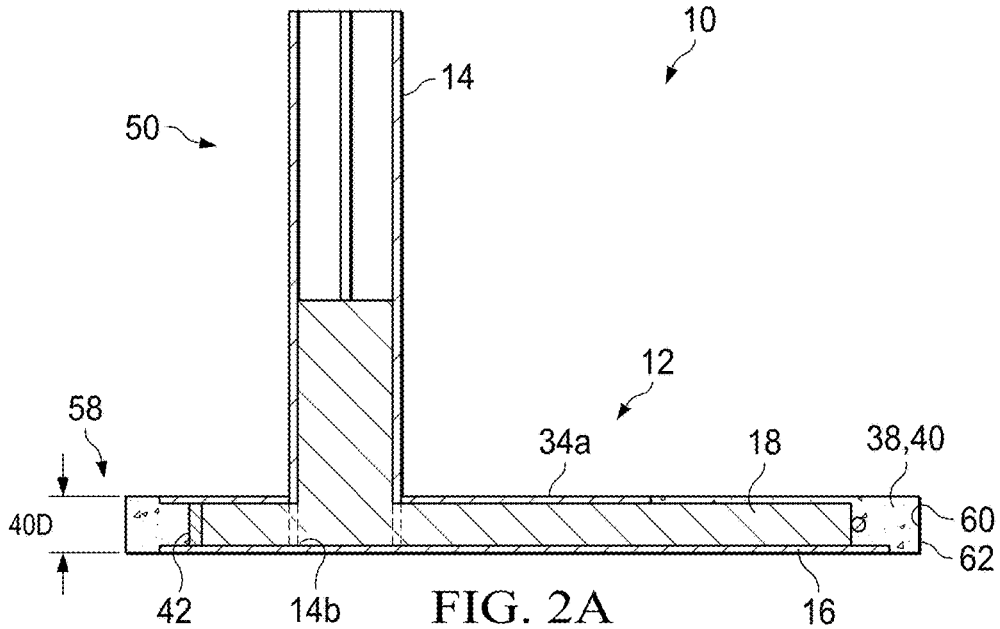
FIG. 2A is an elevation view of an exemplary bollard assembly along the line I-I of FIG. 2.

With reference in particular to FIGS. 1, 2A, 3, and 11, a top plate 34 is mounted at each bollard 14 on top of bollard stiffener 18 and the associated stiffeners 30, 32 with bollard 14 extending through and above top plate 34. Top plates 34 have a smaller surface area and smaller perimeter 134 than the surface area and perimeter 116 of bottom plate 16. Adjacent top plates 34 of adjacent bollards 14 may be separated by an open gap 35 (FIG. 1) that may be filled with concrete when installed in the ground (FIG. 2A). In FIG. 2A the excavation is filled with concrete substantially flush with the top plates with a substantially co-planar surface formed by top plates 34 and the concrete foundation 40.

In a non-limiting example, bottom plate 16 and top plate 34 are 0.5-inch steel plate, e.g., ASTM A572 GR50. Top plate 34 has a perimeter 134 that is smaller than the perimeter 116 of bottom plate 16. In an exemplary embodiment, top plate perimeter 134 is vertically aligned with bottom plate forward edge 16*a* but does not extend to bottom plate perimeter 116 at aft edge 16*b* or along the lateral sides of bottom plate 16. For example, top plate perimeter 134 has a front end 134*a* that is substantially vertically aligned with bottom plate forward edge 16*a* and a rear end 134*b* positioned between bollard 14 and aft end 18*b* of bollard stiffener 18.

Figure 11:
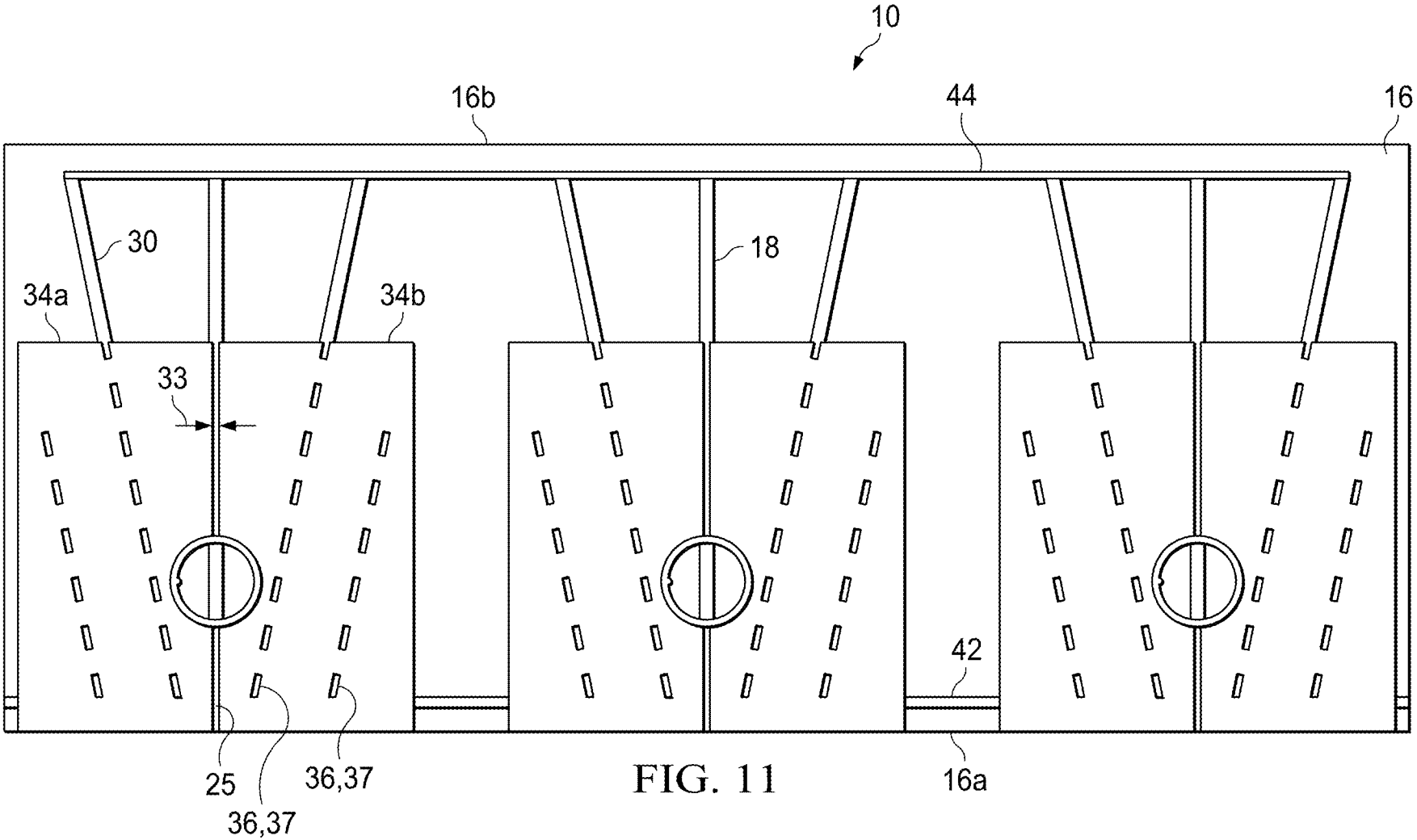
FIG. 11 is a plan view illustrating top plates and an aft reinforcement bar added to an exemplary bollard assembly.
Figure 12:
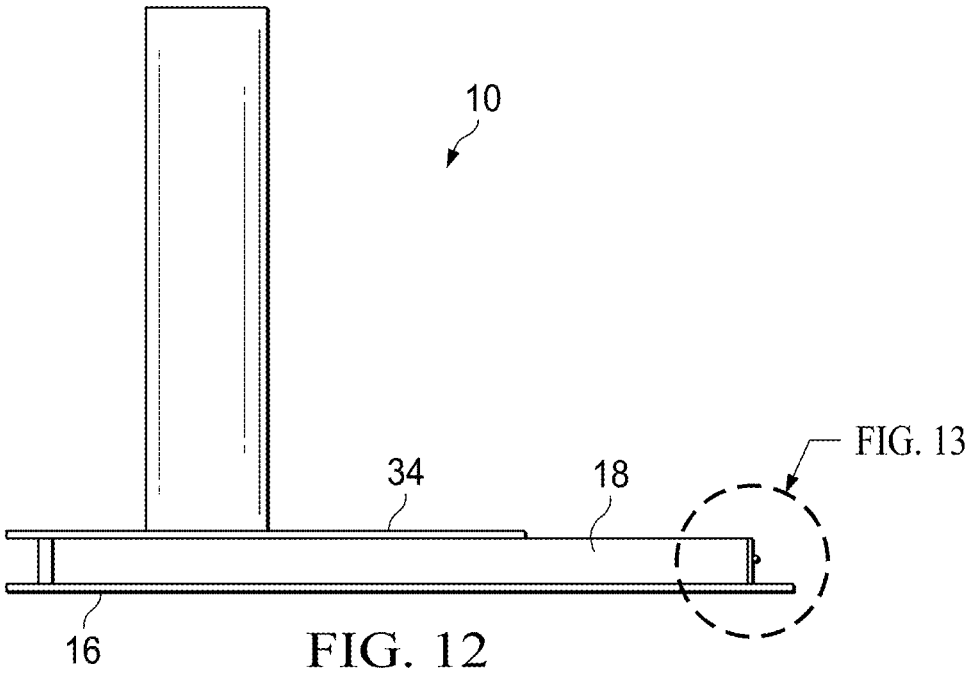
FIG. 12 is a side elevation view of an exemplary bollard assembly illustrating an aft reinforcement bar.
Figure 13:
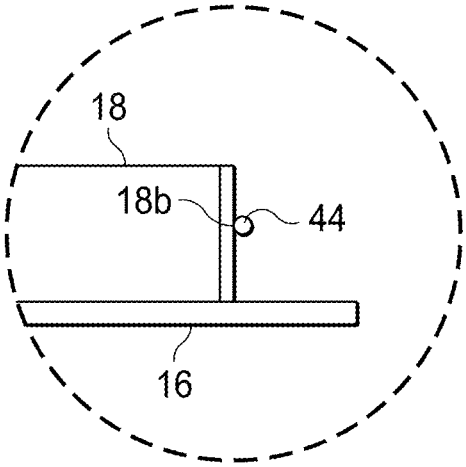
FIG. 13 illustrates a detail view of FIG. 12.

Each top plate 34 may be formed of two top plate panels 34*a*, 34*b* positioned long an interface 33 that is co-axially aligned over bollard stiffener 18. Interface 33 is a gap between plates 34*a*, 34*b* that is less than the width of bollard stiffener 18 allowing plates 34*a*, 34*b* and bollard stiffener 18 to be interconnected for example by a weld 25. In an exemplary embodiment, bollard stiffener has width (thickness) of 1.5 inches and interface 33 is a gap of about 0.75 inches. Weld 25 may fill interface 33. Top plate 34 may have openings 36, e.g., slots, formed above stiffeners 30, 32 for welding top plate 34 to the stiffeners. Openings 36 are filled with welds 37 (FIG. 11). In an exemplary embodiment, top plates 34 do not have any open voids when placing in the excavation.

Bottom plate 16, top plate 34, bollard stiffener 18 and the one or more additional stiffeners 30, 32 form a structure to resist rotation, tipping, of the bollard when it is impacted by a vehicle. This structure and the angling of the bollard stiffener 18 and stiffeners 30 transmit the energy of an impacting vehicle to bottom plate 16 and spread the energy over a section of bottom plate 16. This structure resists tipping of the bollard with respect to impacts along different paths, although the bollard assembly may be configured to provide a greater resistance to rotation for example along the axis of bollard stiffener 18.

A front rail 42 may be secured, e.g., welded, between bottom plate 16 and top plate 34 and in contact with the forward ends 18*a*, 30*a*, 32*a* of the respective stiffeners 18, 30, and 32 at each bollard. For example, in a linear configuration a single front rail 42 extends the forward ends 18*a* of all of the bollard stiffeners 18. In some embodiments, in particular non-linear bollard assemblies, each front rail 42 may extend across only one of the bollards of the assembly or across less than all of the bollards. In some embodiments, each bollard includes a front rail 42 mounted at the forward end of the stiffener. In a non-limiting example, front rail 42 is a 1.5 in. by 4 in., ASTM A36 steel bar. In some embodiments a length of reinforcement bar 44 is mounted along aft ends 18*b*, 30*b* of respective stiffeners 18, 30. Reinforcement bar 44 may be mounted, e.g., welded, proximate the midpoint of the height of aft ends 18*b*, 32*b* (see, e.g., FIGS. 12, 13).

Bollard assembly 10 is configured to be installed with a shallow foundation and does not require reinforcement bars facilitating a quick and simple solution for existing premises and sidewalks with underground utilities. A shallow foundation may be for example about 18 inches or less. Exemplary bollard assemblies 10 are installed with a foundation of approximately 5 inches. For example, an exemplary embodiment is crash-tested and certified M40 P1 under ASTM F2656-15 with a 5-inch concrete foundation.

Figure 3:
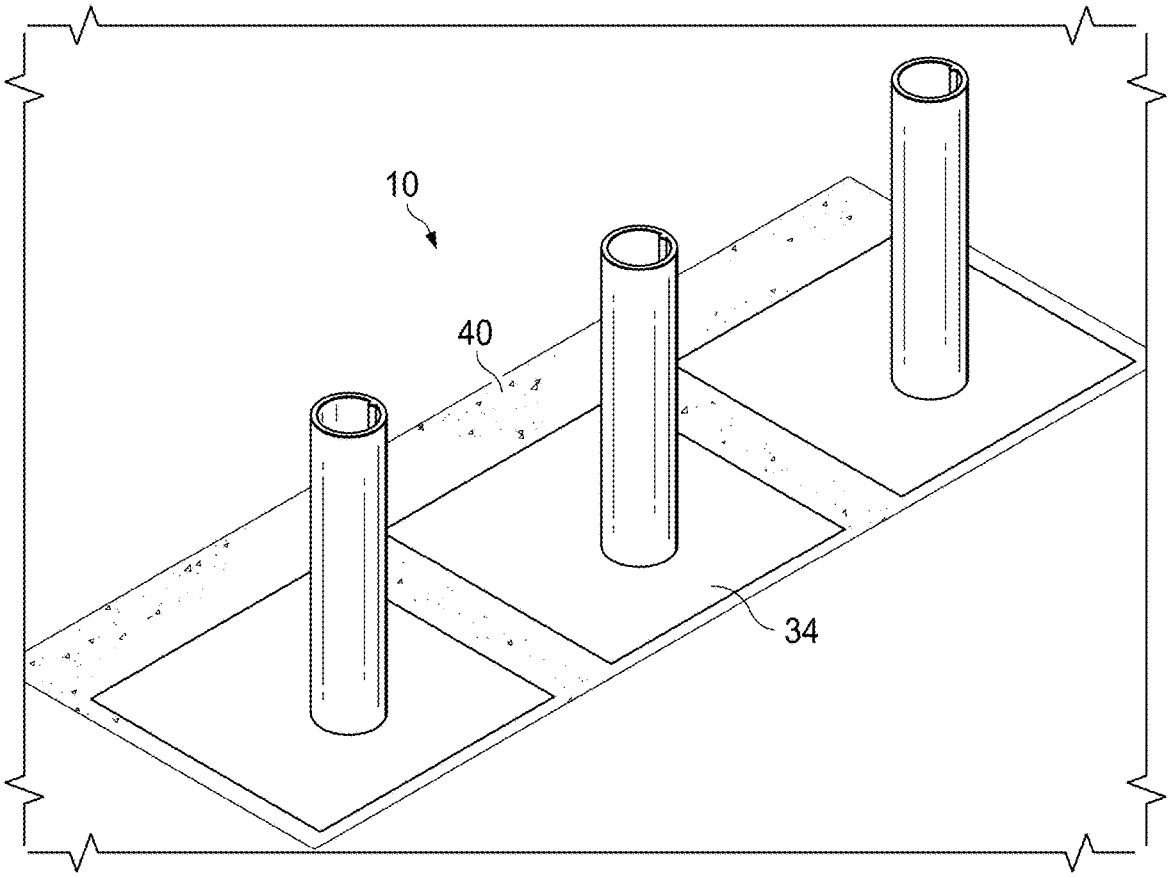
FIG. 3 illustrates an exemplary bollard assembly installed in a concrete foundation.
Figure 4:
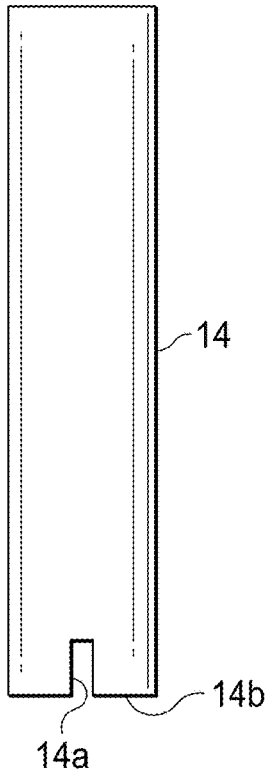
FIG. 4 illustrates an exemplary bollard in isolation.

With reference in particular to FIGS. 2, 2A, and 3, bollard assembly 10 is set in a foundation 40 formed of concrete 38. The base assembly is placed in an excavation 60 having a perimeter wall 62. In an embodiment, the foundation depth 40D may be generally equivalent to the excavation depth and the base height. The width and length of excavation 60 may be larger than the bottom plate perimeter.

Base assembly 12 is placed in excavation 60 with bottom plate 16 on the bottom of the excavation. Wall 62 may be the dirt or concrete sides of excavation 60 or a concrete form positioned in the excavation around the perimeter of bottom plate 16. In an exemplary embodiment, wall 62 is separated from perimeter 116 of bottom plate 16 so that the concrete foundation 40 will extend beyond bottom plate perimeter 116. Concrete 38 is poured on top of the bottom plate filling excavation 60 flush with top plate 34 at minimum to meet a minimum foundation depth for crash certification. After the concrete cures, the concrete form is removed, and the excavation is back filled around concrete foundation 40.

Exemplary concrete foundation 40 extends outside bottom plate perimeter 116 and has a foundation length 40L and foundation width 40W that is greater than bottom plate and base assembly length 16L and width 16W. In the embodiment of FIG. 2, base length 16L is about 14 ft, 4 in., and foundation length 40L is about 14 ft 8 in., and base width 16W is about 72 in. and foundation width 40W is about 78 in. Foundation 40 has a depth 40D from ground level 58 to bottom plate 16. In an exemplary embodiment, the base height and foundation depth 40D is about 12 inches or less. In the exemplary embodiment, the base height and foundation depth 40D is approximately 5 inches from ground level 58 and may be less. For example, bottom plate 16 is approximately 0.5 inches thick, bollard stiffener 18 has a nominal height of 4 inches, and top plate 34 is approximately 0.5 inches thick.

Figure 19:
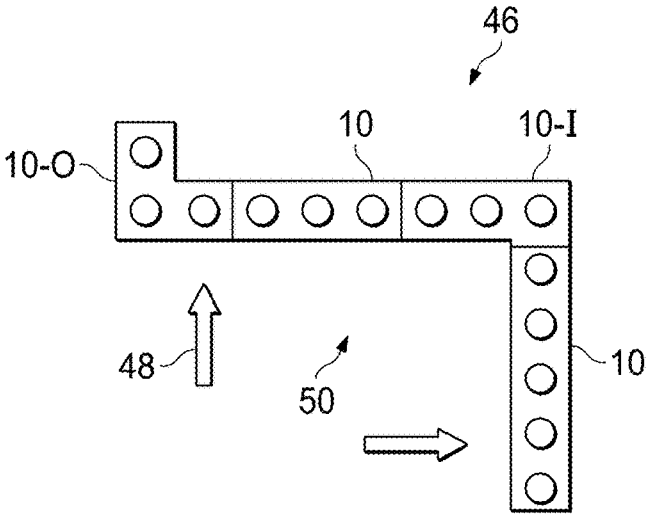
FIG. 19 illustrates an exemplary anti-ram vehicle barrier including two or more bollard assemblies.

Bollard assemblies 10 may be installed end-to-end to form an elongated anti-ram vehicle barrier 46 as illustrated in FIG. 19. Anti-ram vehicle barrier 46 is arranged to stop motor vehicles 48 approaching from an attack side 50. Anti-ram vehicle barrier 46 include turns and is not linear. In the example of FIG. 19, anti-ram vehicle barrier 46 includes more than one linear bollard assemblies 10, an outside bollard assembly corner 10-0, and an inside bollard assembly corner 10-I. A difficulty in forming non-linear anti-ram vehicle barriers is achieving the desired strength and resistance to penetration by motor vehicles at the corners.

Figure 14:
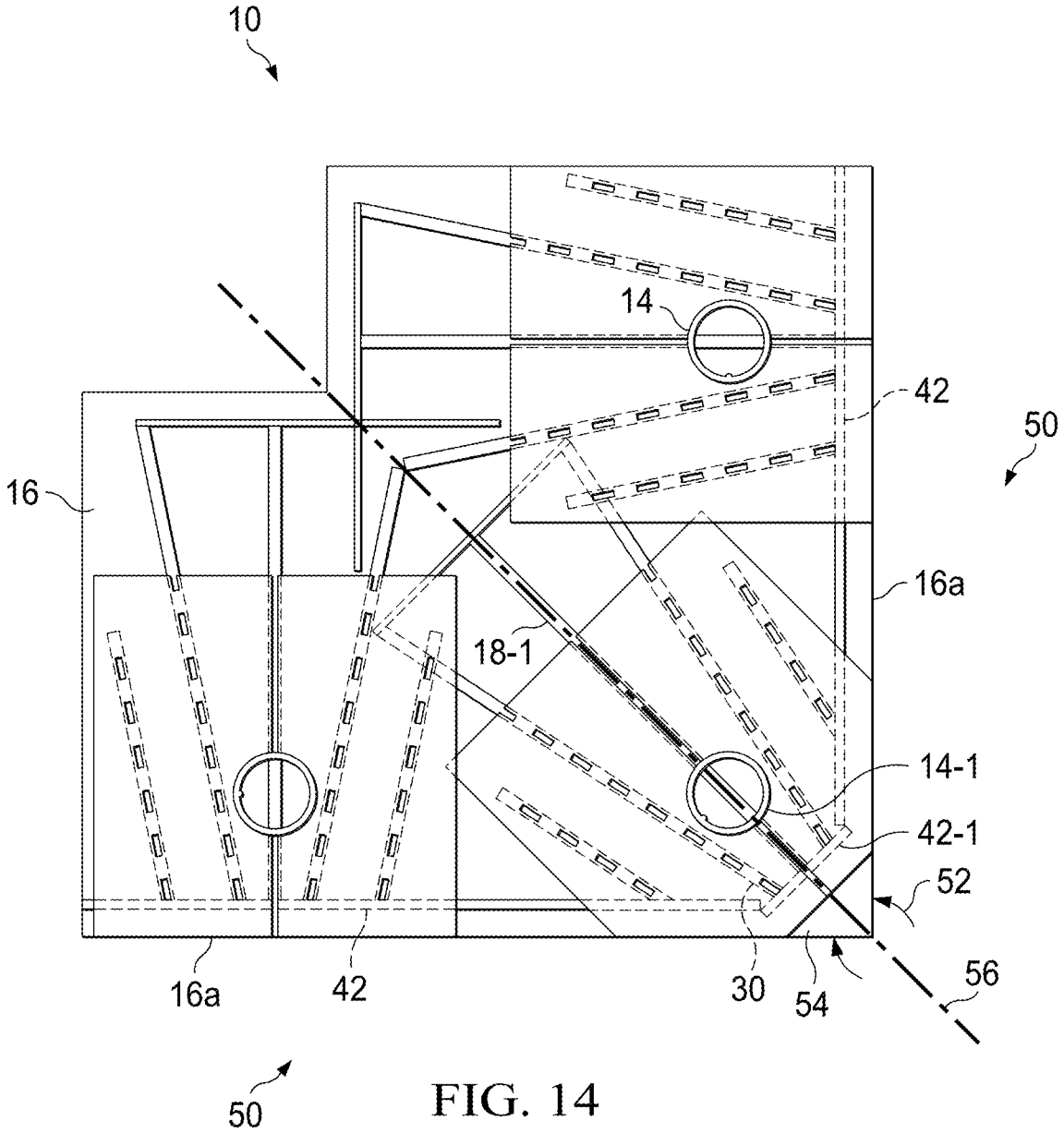
FIG. 14 illustrates an exemplary bollard assembly arranged in a 90-degree outside corner arrangement.

FIG. 14 illustrates an exemplary bollard assembly 10 arranged in a non-linear configuration. Bollard assembly 10 is shown with three bollards 14, however, bollard assembly 10 may have a different number of bollards. In this example, bollard assembly 10 is arranged as a 90-degree outside corner assembly and is exemplary of other corner or non-linear assemblies. Bottom plate 16 is continuous steel plate formed in the shape of the non-linear configuration by one or more members. For example, in the 90-degree outside corner configuration bottom plate 16 is arranged with two attack edges 16*a* extending from the vertex 54 of outside right angle 52. A corner bollard 14-1 is positioned with its respective bollard stiffener 18-1 extending along the axis of symmetry 56 passing through vertex 54 of orthogonal attack edges 16*a*. In this example, bollard assembly 10 has a bollard 14 located on each side of corner bollard 14-1. A front rail 42-1 is mounted in contact with the forward ends of bollard stiffener 18-1 and additional stiffener 30 of corner bollard 14-1. Front rail 42-1 is generally perpendicular to bollard stiffener 18-1. Each of the other bollards 14 has a front rail 42 extending perpendicular to its respective bollard stiffener 18. Similarly, each bollard has a reinforcement bar 44 mounted at the aft end of its respective bollard stiffener 18 and extending perpendicular to the respective bollard stiffener.

Figure 15:
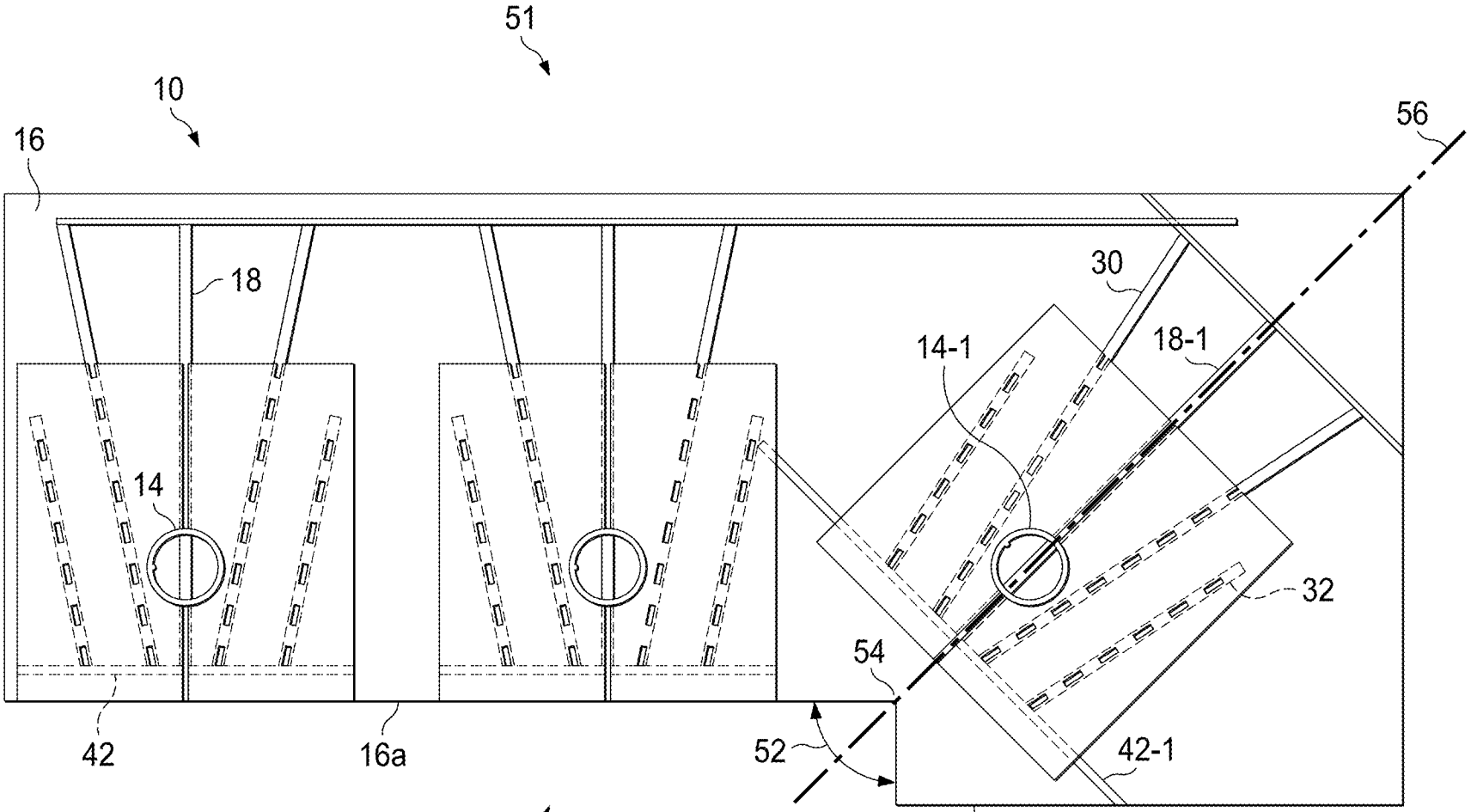
FIG. 15 illustrates an exemplary bollard assembly arranged in a 90-degree inside corner arrangement.

FIG. 15 illustrates an exemplary bollard assembly 10 arranged as a 90-degree outside corner assembly. Bollard assembly 10 is shown with three bollards 14, however, bollard assembly 10 may have a different number of bollards. Bottom plate 16 is continuous steel plate formed by one or more members in an L-shape with a 90-degree angle 52 and is exemplary of other corner or non-linear assemblies. Attack side edges 16*a* are located at the sides forming inside angle 52. A corner bollard 14-1 is shown with its bollard stiffener 18-1 extending along the axis of symmetry 56 of inside corner 52. In this example, corner bollard 14-1 includes additional stiffeners 30, 32 on opposite sides of bollard stiffener 18-1. A front rail 42-1 is mounted in contact with the forward end of bollard stiffener 18-1 of corner bollard 14-1 and extends generally perpendicular to bollard stiffener 18-1. Additional front rails 42, as may be necessary, are arranged in contact with bollard stiffeners 18 of the respective bollards 14 positioned on opposite sides of corner bollard 14-1. In this example, bollard assembly 10 has two bollards 14 located on the same side of corner bollard 14-1 and thus assembly 10 uses a single front rail 42 mounted with both of the additional bollards.

Figure 16:
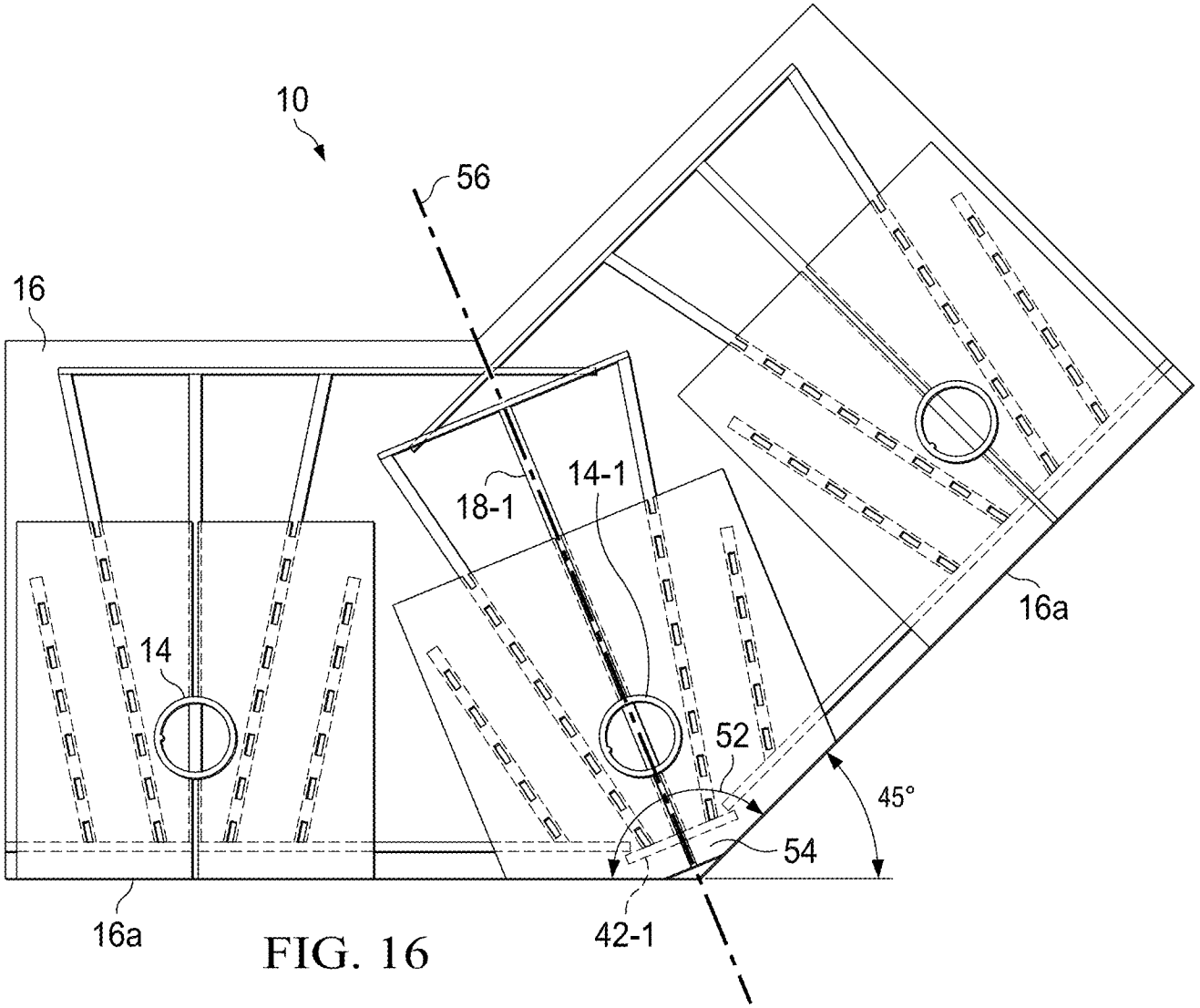
FIG. 16 illustrates an exemplary bollard assembly arranged in a non-linear and non-perpendicular outside corner arrangement.

FIG. 16 illustrates an exemplary bollard assembly 10 arranged in a non-linear and non-perpendicular corner arrangement. Bollard assembly 10 is shown with three bollards 14, however, bollard assembly 10 may have a different number of bollards. Bottom plate 16 is a continuous steel plate formed of one or more members with attack edges 16*a* extending about 45-degrees from one another at angle 52 (about 135-degrees). A corner bollard 14-1 is positioned at angle 52 with its bollard stiffener 18-1 extending along axis of symmetry 56 of angle 52. A front rail 42-1 is in contact with the forward end of bollard stiffener 18-1 of corner bollard 14-1 and extending generally perpendicular to bollard stiffener 18-1.

Figure 17:
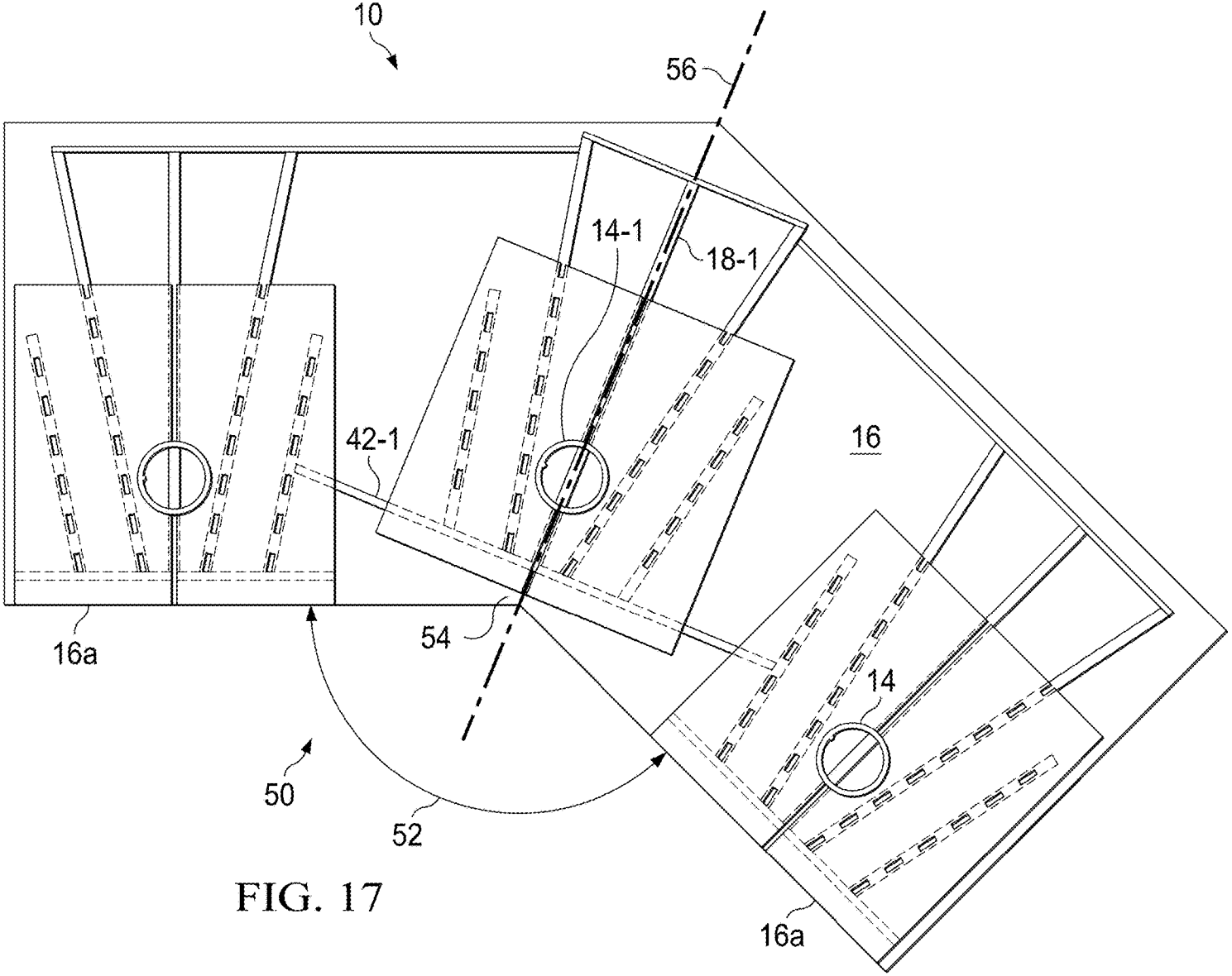
FIG. 17 illustrates an exemplary bollard assembly arranged in a non-linear and non-perpendicular inside corner arrangement.

FIG. 17 illustrates an exemplary bollard assembly 10 is arranged in a non-linear and non-perpendicular corner arrangement. Bollard assembly 10 is shown with three bollards 14, however, bollard assembly 10 may have a different number of bollards. Bottom plate 16 is continuous steel plate formed of one or more members with attack edges 16*a* extending about 45-degrees from one another at angle 52 (about 135-degrees). A corner bollard 14-1 is positioned at angle 52 with its bollard stiffener 18-1 extending along axis of symmetry 56 of angle 52. A front rail 42-1 is in contact with the forward end of bollard stiffener 18-1 of corner bollard 14-1 and extending generally perpendicular to bollard stiffener 18-1.

Figure 18:
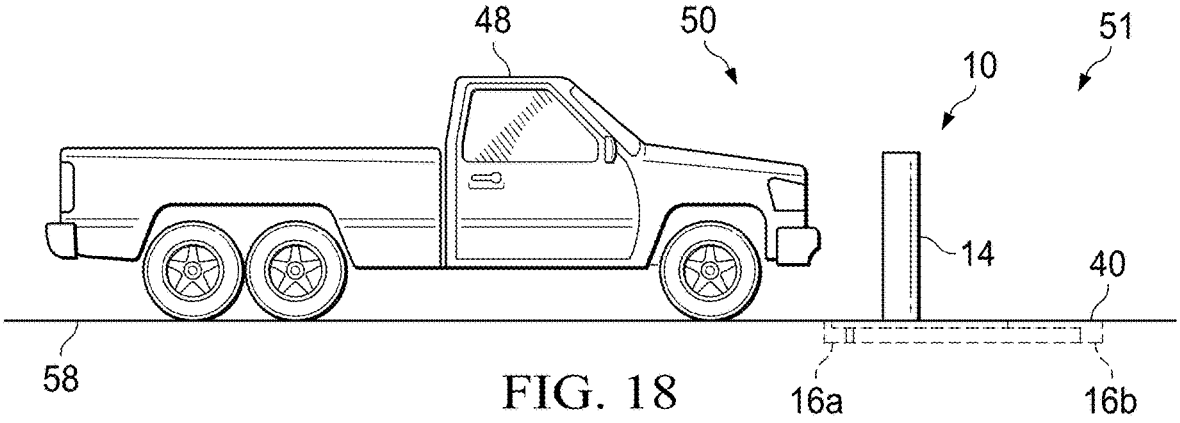
FIG. 18 illustrates a motor vehicle approaching an exemplary bollard assembly from an attack side.

FIG. 18 illustrates a motor vehicle 48 approaching a bollard assembly 10 from an attack side 50 and travelling toward the protected side 51. With reference to all of the figures, an exemplary method includes installing a bollard assembly 10 with base assembly 12 in the ground and a vertical bollard 14 extending above a ground level 58. In some embodiments, the top plate 34 of the base is generally flush with ground level 58 and may be exposed. Bollard 14 is impacted with a vehicle 48 of substantial mass, for example a car or truck, traveling in a direction from a forward edge 16*a* of the bollard assembly toward an aft edge 16*b*. Bollard assembly 10 stops or slows the penetration of vehicle 48 into the protected areas. In some embodiments, bollard assembly 10 stops motor vehicle 48 within a distance of the impacted bollard to achieve an ASTM F2656, ASTM F3016, PAS68, IWA 14-1, or similar anti-ram or safety rating.

In an exemplary embodiment, motor vehicle 48 has a weight of approximately 15,000 pounds impacts the bollard at a speed of approximately 28 mph or greater and is stopped within a distance of approximately 98 feet (30 m) or less. In another embodiment, vehicle 48 is stopped within approximately 23 feet (7 m) or less. In another embodiment, vehicle 48 is stopped within approximately 3.3 feet (1 m) or less. For example, bollard assembly 10 may achieve an ASTM F2656 M30-P1, M30-P2, or M30-P3 rating.

In an exemplary embodiment, motor vehicle 48 has a weight of approximately 15,000 pounds or greater traveling approximately 38 mph or greater on impact, and the distance is approximately 98 feet (30 m) or less. In another embodiment, vehicle 48 is stopped within approximately 23 feet (7 m) or less. In another embodiment, vehicle 48 is stopped within approximately 3.3 feet (1 m) or less. For example, bollard assembly 10 may achieve an ASTM F2656 M40-P1, M40-P2, or M40-P3 rating.

In another exemplary embodiment, motor vehicle 48 has a weight of approximately 15,000 pounds or greater and traveling approximately 47 miles per hour or greater on impact, within a distance of approximately 98 feet (30 m) or less. In another embodiment, vehicle 48 is stopped within approximately 23 feet (7 m) or less. In another embodiment, vehicle 48 is stopped within approximately 3.3 feet (1 m) or less. For example, bollard assembly 10 may achieve an ASTM F2656 M50-P1, M50-P2, or M50-P3 rating.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features.

The term "substantially," "approximately," and "about" is defined as largely but not necessarily wholly what is specified (and includes what is specified; e.g., substantially 90 degrees includes 90 degrees and substantially parallel includes parallel), as understood by a person of ordinary skill in the art. The extent to which the description may vary will depend on how great a change can be instituted and still have a person of ordinary skill in the art recognized the modified feature as still having the required characteristics and capabilities of the unmodified feature. In general, but subject to the preceding, a numerical value herein that is modified by a word of approximation such as "substantially," "approximately," and "about" may vary from the stated value, for example, by 0.1, 0.5, 1, 2, 3, 4, 5, 10, or 15 percent.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A bollard assembly, comprising:

a bottom plate having a bottom plate perimeter with a forward edge and an aft edge;

an elongated member mounted on the bottom plate and extending from a forward end to an aft end in a direction from the forward edge toward the aft edge, the elongated member including a bollard section with a vertical height, a forward section from the bollard section to the forward end, an aft section from the bollard section to the aft end, and the forward section and the aft section having a nominal height that is less than the vertical height;

a bollard attached to the bottom plate with the bollard section disposed inside of the bollard;

bars, mounted on the bottom plate on opposite sides of the elongated member, extending in a direction from the forward end toward the aft end; and a top plate, having a front end, a rear end, and a top plate perimeter that is smaller than the bottom plate perimeter, mounted on the elongated member and the bars with the bollard extending above the top plate.

2. The bollard assembly of claim 1, wherein the bollard, the bottom plate, the top plate, and the elongated member are constructed of steel.

3. The bollard assembly of claim 1, wherein the top plate comprises two plate members arranged along an interface co-axial with the elongated member.

4. The bollard assembly of claim 1, wherein the elongated member and the bars do not extend to the forward edge or the aft edge.

5. The bollard assembly of claim 1, wherein the bars do not extend to the forward edge or the aft edge; and the top plate comprises two plate members arranged along an interface co-axial with the elongated member.

6. The bollard assembly of claim 1, wherein the front end of the top plate is substantially vertically aligned with the forward edge and the rear end of the top plate is located between the bollard and the aft end of the elongated member.

7. The bollard assembly of claim 1, wherein the bollard comprises a pipe seam and the elongated member is substantially normal to the pipe seam.

8. The bollard assembly of claim 1, wherein the front end of the top plate is substantially vertically aligned with the forward edge and the rear end of the top plate is located between the bollard and the aft end of the elongated member; and the elongated member does not extend to the bottom plate perimeter.

9. The bollard assembly of claim 1, comprising a base height extending from a bottom of the bottom plate to a top of the top plate, wherein the base height is about 12 inches or less.

10. The bollard assembly of claim 9, wherein the top plate comprises two plate members arranged along an interface co-axial with the elongated member.

11. The bollard assembly of claim 9, wherein the elongated member does not extend to the bottom plate perimeter; and the front end of the top plate is substantially vertically aligned with the forward edge and the rear end of the top plate is located between the bollard and the aft end of the elongated member.

12. The bollard assembly of claim 1, comprising a base height extending from a bottom of the bottom plate to a top of the top plate, wherein the base height is about 5 inches or less.

13. The bollard assembly of claim 12, wherein the top plate comprises two plate members arranged along an interface co-axial with the elongated member.

14. The bollard assembly of claim 12, wherein the elongated member does not extend to the bottom plate perimeter; and the front end of the top plate is substantially vertically aligned with the forward edge and the rear end of the top plate is located between the bollard and the aft end of the elongated member.

15. A bollard assembly, comprising:

a bottom plate having a bottom plate perimeter with a forward edge and an aft edge;

an elongated member mounted on the bottom plate and extending from a forward end to an aft end in a direction from the forward edge toward the aft edge, the elongated member including a bollard section with a vertical height, a forward section from the bollard section to the forward end, an aft section from the bollard section to the aft end, and the forward section and the aft section having a nominal height that is less than the vertical height;

a bollard attached to the bottom plate with the bollard section disposed inside of the bollard;

a rail having the nominal height mounted on the bottom plate proximate the forward end and extending substantially normal to the elongated member;

bars, mounted on the bottom plate on opposite sides of the elongated member, extending in a direction from the forward end toward the aft end; and a top plate, having a front end, a rear end, and a top plate perimeter that is smaller than the bottom plate perimeter, mounted on the elongated member and the bars with the bollard extending above the top plate.

16. The bollard assembly of claim 15, wherein the bars and the elongated member do not extend to the bottom plate perimeter.

17. The bollard assembly of claim 15, wherein the front end of the top plate is substantially vertically aligned with the forward edge and the rear end of the top plate is located between the bollard and the aft end of the elongated member.

18. The bollard assembly of claim 15, wherein the top plate comprises two plate members arranged along an interface co-axial with the elongated member.

19. The bollard assembly of claim 15, comprising a base height extending from a bottom of the bottom plate to a top of the top plate, wherein the base height is about 5 inches or less.

20. The bollard assembly of claim 19, wherein the front end of the top plate is substantially vertically aligned with the forward edge and the rear end of the top plate is located between the bollard and the aft end of the elongated member.

* * * * *